United States Patent [19]

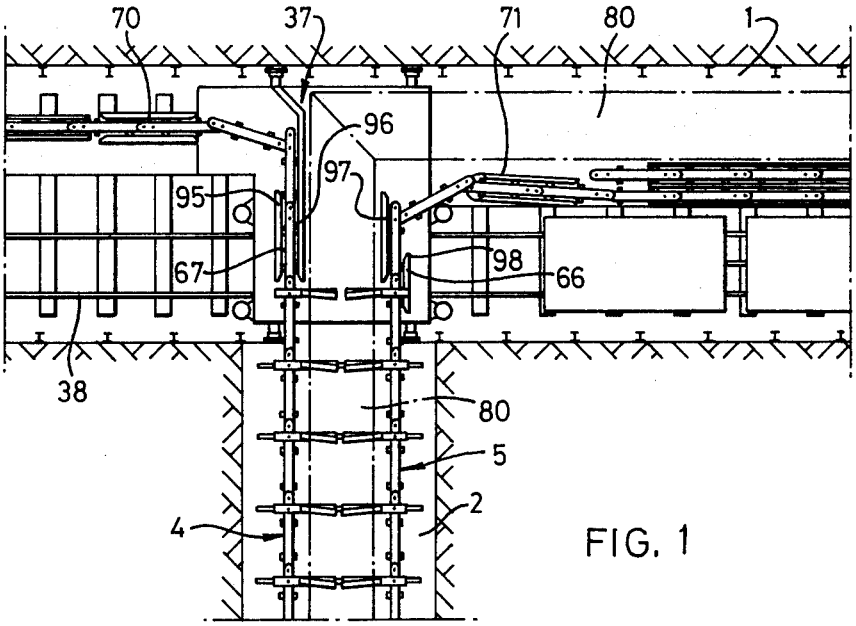
FIG. 1
FIG. 2
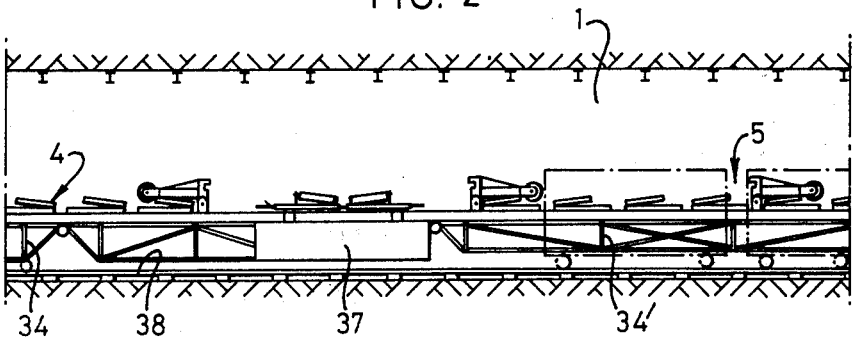

Dawson

[11] 4,173,280

[45] Nov. 6, 1979

[54] APPARATUS FOR DRIVING A MINING MACHINE INTO A DRIVEWAY EXTENDING FROM A MINING ROADWAY

[75] Inventor: Gordon B. Dawson, Hulland Ward, England

[73] Assignee: Atlow Mining Development Consultants Limited, Hulland Ward, England

[21] Appl. No.: 839,390

[22] Filed: Oct. 4, 1977

[30] Foreign Application Priority Data

Jul. 7, 1977 [GB] United Kingdom ..... 28522/77

[51] Int. Cl.[2] ..... B65G 15/60

[52] U.S. Cl. ..... 198/812; 226/115

[58] Field of Search ..... 299/64, 67, 19, 31; 61/45 D; 198/812, 862, 586, 316; 226/115

[56] References Cited

U.S. PATENT DOCUMENTS 3,319,778 5/1967 Bessant ..... 198/834

FOREIGN PATENT DOCUMENTS 469306 12/1928 Fed. Rep. of Germany ..... 198/859

1179169 10/1964 Fed. Rep. of Germany ..... 61/45 D 967845 8/1964 United Kingdom ..... 198/812

*Primary Examiner*—Robert B. Reeves

*Assistant Examiner*—Douglas D. Watts

*Attorney, Agent, or Firm*—Diller, Ramik & Wight

[57] ABSTRACT

Apparatus for use in driving a mining machine into a driveway extending laterally from a mine roadway comprises a chain of axially extending push rods for engaging the mining machine, each push rod being coupled to an adjacent push rod by a connection which allows relative pivotal movement of the push rods, and feeder apparatus comprising a first thrust mechanism acting in the direction of the driveway and arranged to apply force to that part of the chain aligned with the driveway, and a second thrust mechanism acting in the direction of the roadway and arranged to apply force to that part of the chain aligned along the roadway, and a control device for operating the first and second thrust mechanisms together.

4 Claims, 9 Drawing Figures

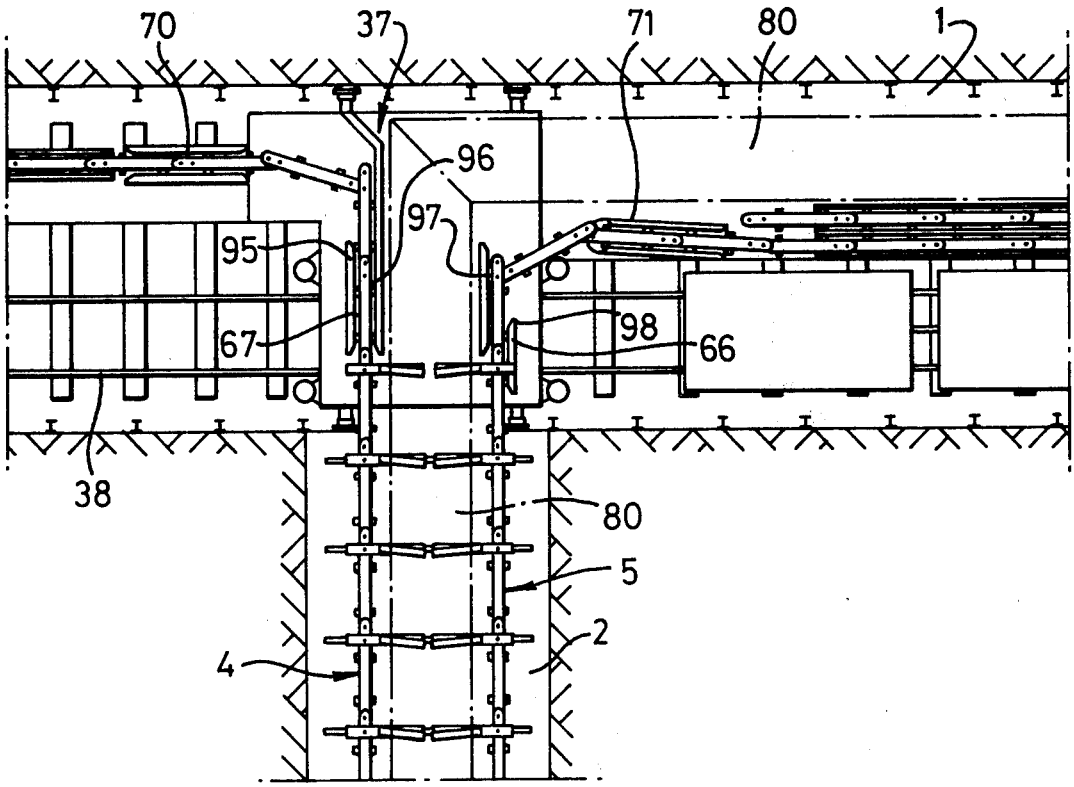

APPARATUS FOR DRIVING A MINING MACHINE INTO A DRIVEWAY EXTENDING FROM A MINING ROADWAY

This invention relates to apparatus for driving mining machines.

In one known mining technique suitable for excavating stratified mineral deposits such as coal, a roadway, ie a tunnel large enough to carry men and machinery, is driven through the seam of material and the surrounding strata. Material is then excavated from the seam adjacent the roadway using a remotely controlled mining machine which comprises a plurality of cutting heads mounted on a frame. The machine is driven into the seam at right angles to the roadway by means of a chain of connected push rods operated by a feeder mechanism mounted in the roadway. The machine is then withdrawn from the driveway, the mouth of the driveway is closed and a further driveway is then excavated adjacent and parallel to the first. This process is then repeated at regular intervals along the length of the roadway.

The push rods are usually pivoted together so that they can be assembled into a chain prior to use and stored in a line along the roadway adjacent the driveway. As the driveway is excavated the pivotal connections between adjacent push rods allows the chain to be bent through 90° and fed into the driveway by the feeder mechanism.

Hitherto, the feeder mechanisms have comprised an hydraulically-operated thrust mechanism arranged to apply force to the push rods only in the direction of the driveway. As a result, it has been necessary to attach each push rod to the chain as the chain is fed into the driveway. However this is a relatively time-consuming and strenuous process. Alternatively, the assembled chain of push rods may be stationed in the roadway and fed along a curved path into the driveway. In order to enable the feeder mechanism to pull the chain smoothly into alignment with the driveway however, the chain must be bent around a relatively shallow curve in which adjacent push rods are inclined to each other at a small angle, e.g. no more than 30°.

In practice it is not economical to support or maintain winning mine roadways of widths greater than about 14 feet. Moreover, the roadway accommodates a conveyor, which extends along the whole length of the roadway, and the mining machinery necessary for excavation of the driveway. Consequently, the space available for the curved section of the chain is considerably less than the maximum width of the roadway. In order to accommodate this section of the chain in the available space and, at the same time, to ensure that adjacent push rods in the curved section of the chain are inclined at the necessary shallow angle to each other, the push rods must be relatively short, e.g. one or two feet in length. The chain is therefore composed of a relatively large number of individual components and is consequently more susceptible to damage or distortion under stress than a similar chain composed of longer push rods.

According to the present invention, there is provided apparatus for feeding a chain of connected push rods into a driveway extending laterally from a mine roadway and comprising a first thrust mechanism for applying force to the push rods along the driveway, and a second thrust mechanism operable together with the first thrust mechanism for applying force to the push rods along the roadway.

By using two thrust mechanisms together adjacent push rods in the chain can be inclined to each other at a much greater angle than in the conventional feeding mechanisms, thus allowing longer push rods to be used. The thrust mechanism itself can also be of a more efficient and convenient construction.

More specifically, the present invention provides apparatus for driving a mining machine into a driveway extending laterally from a mine roadway and comprising a chain of axially extending push rods for engaging the mining machine, each push rod being coupled to an adjacent push rod by a connection which allows relative pivotal movement of the push rods; and feeder apparatus comprising a first thrust mechanism acting in the direction of the driveway and arranged to apply force to that part of the chain aligned with the driveway, and a second thrust mechanism acting in the direction of the roadway and arranged to apply force to that part of the chain aligned along the roadway, and a control device for operating the first and second thrust mechanisms together.

Generally, two chains of push rods will be used to drive the mining machine into the driveway. Preferably therefore, the first thrust mechanism comprises two drives for applying force along the driveway to two chains of push rods, which can be connected transversely, and the second thrust mechanism comprises two further drives each for applying force along the roadway to a respective one of the chains and each operable in synchronism with a respective one of the drives of the first thrust mechanism.

Although the chains of push rods may be arranged adjacent to each other in the roadway, preferably, the chains extend along the roadway in opposite directions so that the mouth of the driveway is equally accessible from both sides. The two drives of the second thrust mechanism of the apparatus are therefore preferably arranged to act in opposite directions.

Suitably, the drives of the first and second thrust mechanisms each comprise hydraulic cylinders and releasable couplings for connecting the cylinders to the push rods. In the preferred embodiment of the invention, these releasable couplings comprise hydraulically operable latches mounted on the hydraulic cylinders.

The chains of push rods are arranged axially in the roadway prior to being fed into the driveway. If desired, two or more chains of push rods may be stored side by side in the roadway in parallel lines. When it is intended to store the chains of push rods in this way, one or both the drives of the second thrust mechanism is preferably adjustable to act along the roadway in a plurality of different angular positions so that the thrust mechanism can be coupled to each of a plurality of adjacent chains of push rods extending along the roadway.

The first thrust mechanism, and preferably also the second thrust mechanism, is conveniently mounted on a frame adapted to be positioned in the roadway. This frame then can act as a launching platform for the mining machine and can define a horizontal working surface over which the push rods can be drawn. The frame preferably includes means for securing the frame in engagement with the walls of the roadway, for example one or more hydraulic jacks extendable laterally from the frame into engagement with at least one, and preferably both, walls of the roadway.

The material excavated from the driveway is usually withdrawn therefrom on a conveyor. The frame is therefore preferably adapted to carry a conveyor belt and includes means for turning upper and lower runs of the conveyor belt through 90° so that the material excavated from the driveway is carried down the driveway and along the roadway by the same conveyor belt.

A preferred embodiment of a feeder apparatus according to the invention will now be described by way of example only with reference to the drawings in which:

FIG. 1 is a plan of a mine roadway and a driveway extending therefrom and formed by a mining machine operated with the feeder apparatus;

FIG. 2 is a cross section of the excavation of FIG. 1;

Figure 3:
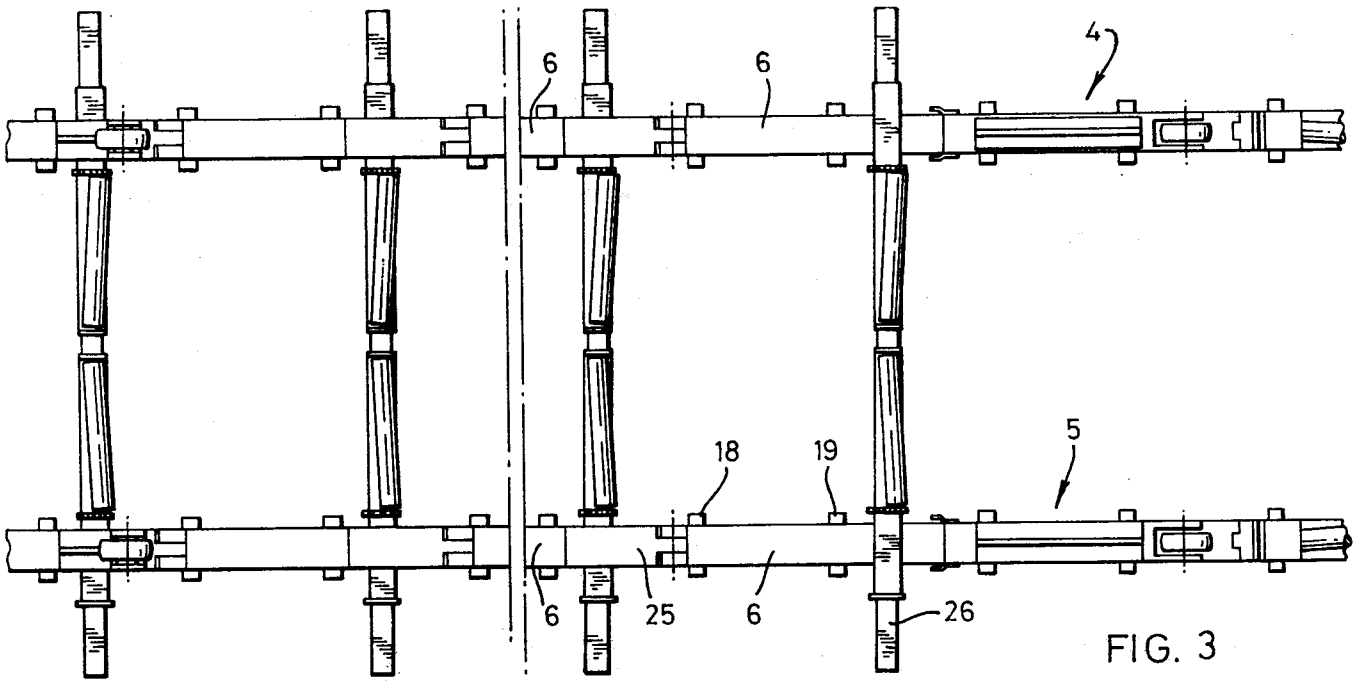
FIG. 3 is a plan on an enlarged scale showing push rods used with the feeder apparatus of the invention.
Figure 4:
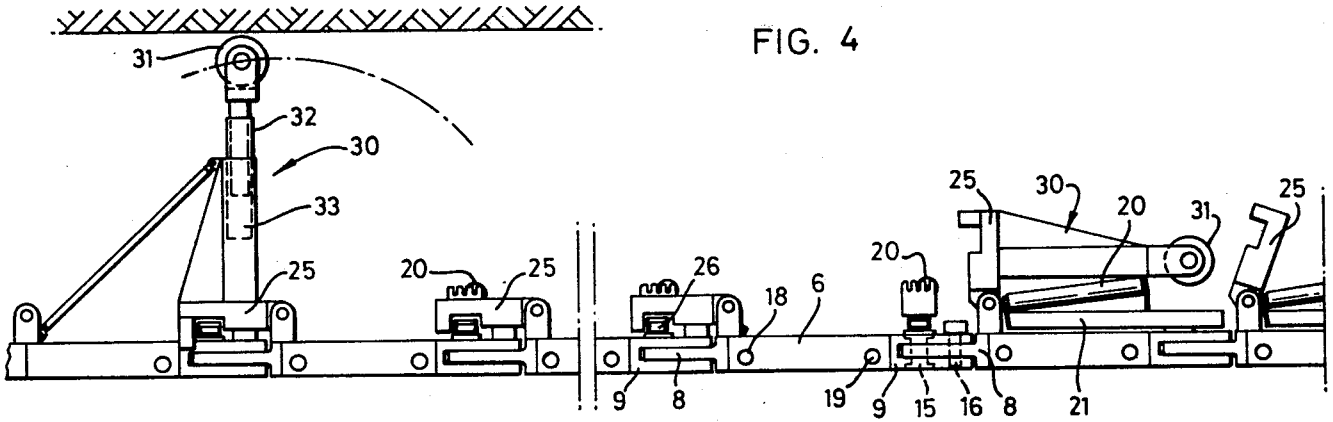
FIG. 4 is a side elevation of the push rods of FIG. 3.

Referring to the drawings, FIGS. 1 and 2 illustrate a mine roadway 1 and a driveway 2 extending laterally from the roadway 1 at right angles thereto. The driveway 2 is in the course of excavation by a mining machine (not shown) which is advanced into the driveway by means of two chains of push rods 4, 5, illustrated in more detail in FIGS. 3 and 4. Referring to FIGS. 3 and 4, each chain of push rods 4, 5 comprises a plurality of axially extending thrust rods 6, each of which is provided at one end with a tongue 8 and, at the other end, with a clevis 9 adapted to receive the tongue 8 of an adjacent push rod. Each tongue and clevis 8, 9 includes two sets of apertures, the apertures in the clevis 9 being in axial alignment with the apertures in the tongue 8 of an adjacent push rod 6 when the tongue 8 of the adjacent push rod 6 is received in the clevis 9 and the two push rods 6 are in axial alignment. Adjacent push rods are permanently pivoted together by means of a swivel pin 15 (see FIG. 4) which passes through the aperture nearest the end of the tongue 8 of one of the push rods. A removable locking pin 16 can be passed through the second set of aligned apertures in order to lock the adjacent push rods 6 in axial alignment with each other.

Each push rod also includes two transverse drive pins 18, 19 the ends of which project from the sides of the push rod. A conveyor roller 20 is pivotally mounted on a tubular bracket 21 fixed to each hinge pin 15 for movement between a withdrawn position, in which the conveyor roller 20 overlies the push rod 6, and an extended position in which the conveyor roller 20 lies at right angles to the push rod 6. Bars 26 can be passed through the brackets on which the conveyor rollers 20 are mounted, thus linking adjacent push rods in the chains, and locking the conveyor rollers 26 in their extended positions. A latch 25 is pivotably mounted on the opposite end of each push rod from the conveyor roller. Each latch 25 defines a recess which conforms to the transverse cross-section of the conveyor rollers 20 so that, as seen in FIG. 4, the latch 25 can be lowered over the conveyor roller 20 when the conveyor roller 20 is in its extended position, thus locking the roller in position.

Every fifth latch 25 along the chains of push rods carries a roof support 30 which comprises a roller 31 mounted on a spring loaded piston 32 received within a cylinder 33 fixed to the latch 25. It will be appreciated that the roof supports could be positioned at greater or shorter intervals along the chains, for example on every latch, or on every second or third latch.

The chains of push rods 6 extend along the roadway in opposite directions and are supported on carriages 34, 34' (see FIG. 2). The carriages on the left hand side of the driveway 2 as seen in FIG. 1 carry a single chain of push rods 8, the carriages 34' on the opposite side carry two adjacent parallel chains of push rods 8.

The chains 4, 5 of push rods 6 are fed into and out of the driveway 2 by means of a feeder mechanism 37. As best seen in FIGS. 5 to 9, the feeder mechanism 37 comprises a main frame 40 which carries two sets of wheels 41, 42 by means of which the feeder mechanism 37 can be driven along rails 38 in the roadway 1. Four hydraulic jacking cylinders 45 extend downwardly from the main frame 40 and may be extended in order to raise the main frame 1. Four staking cylinders 48 extend horizontally from the main frame 40 parallel with the axles of the wheels 41, 42 and may be extended into contact with the walls of the roadway 1 in order to fix the lateral position of the main frame 40 within the roadway 1.

Figure 7:
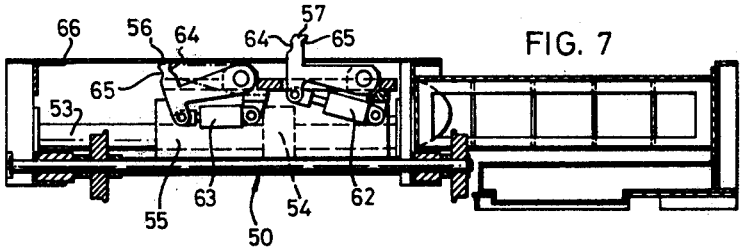
FIG. 7 is a transverse cross-section of the mechanism taken along line D—D of FIG. 5.
Figure 8:
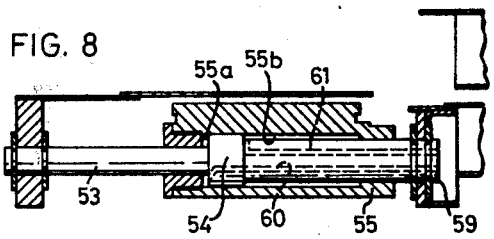
FIG. 8 is a vertical cross section through part of the apparatus illustrated in FIG. 7
Figure 9:
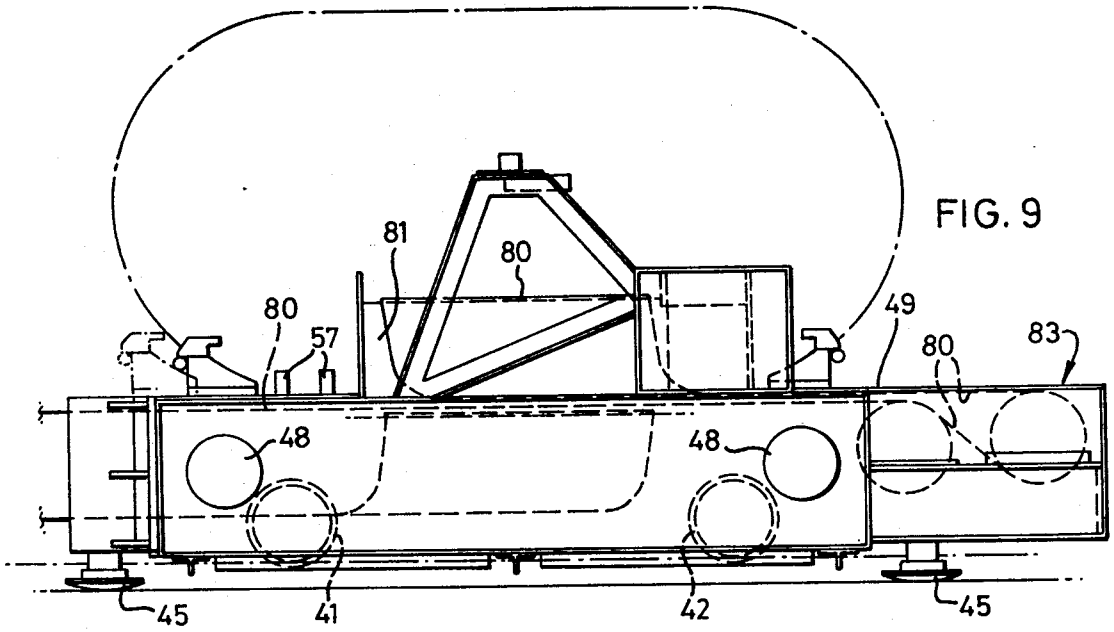
FIG. 9 is an end elevation of the mechanism illustrated in FIG. 5.

The main frame 40 has an upper horizontal working surface 49 beneath which is mounted a first thrust mechanism which is composed of two hydraulic drives 50, 51 each of which is associated with a respective one of the chains of push rods 4, 5. As best shown in FIGS. 7 and 9 which illustrates one of the hydraulic drives 50 or 51, each drive comprises a fixed piston rod 53 on which is mounted a piston 54 housed with a cylinder 55 which is slidable along the piston rod 53. The piston 54 divides the cylinder 55 into two chambers **55*a, b* each of which communicates with an hydraulic fluid control valve 59 by means of passages 60, 61 in the piston rod 53. By introducing hydraulic fluid into one of the chambers 55*a, b* and removing it from the other, the piston 55 can be reciprocated along the rod 53**.

The cylinder 55 carries two latches 56, 57 which are both pivotable in a vertical plane so that each of the latches can be raised by means of an hydraulic cylinder 62, 63. Each of the latch members 56, 57 carries two indentations 64, 65, on opposite sides, each indentation conforming to the surface of the drive pins mounted in the push rods 5. In their raised positions, the latches project through slots 66, 67 in the working surface 49 of the frame 40.

Figure 5:
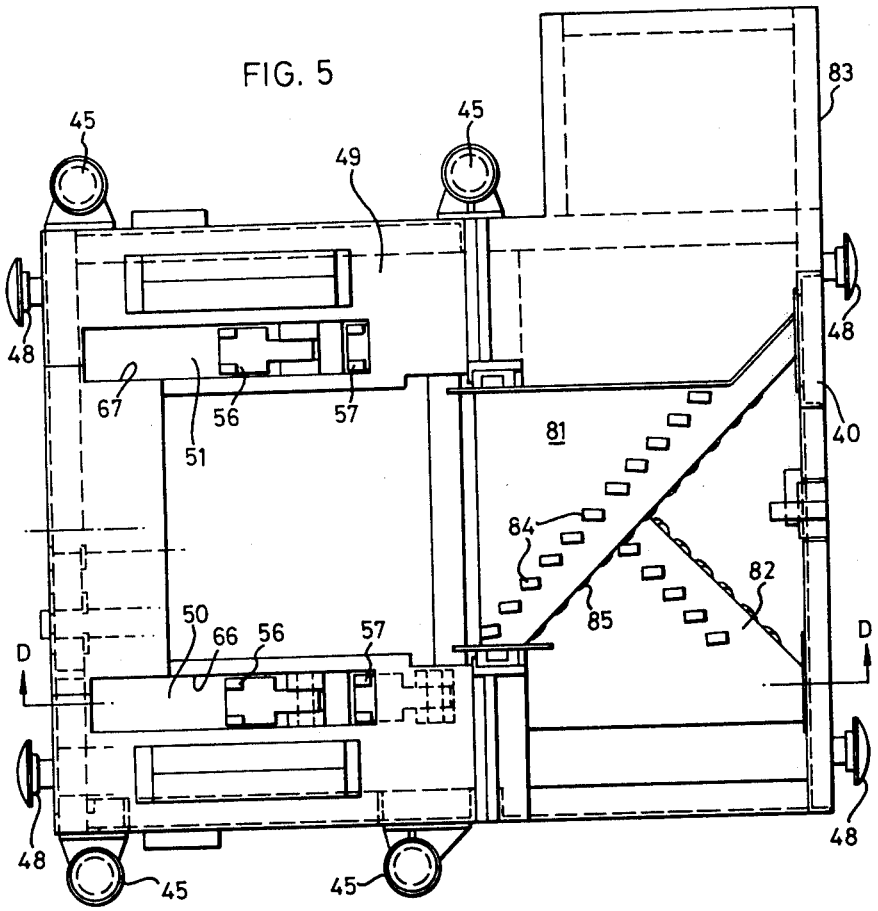
FIG. 5 is a plan of the feeder mechanism of the invention.

A conveyor belt 80 removes material excavated from the driveway 5 and passes this material along the roadway 1. In order to turn the conveyor belt 80 from the driveway to the roadway, the frame 40 includes two angle plates 81, 82 and a tensioning unit 83 mounted on the side of the frame 40 remote from the mouth of the driveway 2. As best seen in FIG. 5, each of the angle plates 81, 82 comprises an array of apertures 84 in each of which is located a roller 85 which facilitates the passage of the conveyor belt over the plates 81, 82. The upper run of the conveyor 80 passes along the driveway 2, over the upper angle plate 81 and then to a tensioning unit 83. The tensioning unit 83 returns the upper run through the frame 40 immediately beneath the working surface 49 above the staking cylinders 48. The lower run of the conveyor 80 passes from the roadway 1 below the upper run of the conveyor and enters the frame 40 beneath the staking cylinders 48. The lower run then passes upwardly over the lower angle plate 82 which twists the lower run into alignment with the driveway 2 at a level immediately beneath the working surface 49 of the main frame 40.

A ventilation duct 90 is supported on the main frame 1 immediately beneath the angle plates 81, 82. An optical sighting device 92 is supported on the side of the frame 40 remote from the driveway 2.

As best seen in FIG. 1, the feeding apparatus further comprises a second thrust mechanism which is composed of two hydraulic drives 70, 71 each similar to the hydraulic drives of the first thrust mechanism except that each drive carries only a single latch 56 and is reciprocable through a stroke twice as long as the strokes of the drives 50, 51 of the first thrust mechanism. The hydraulic drives 70, 71 are mounted on opposite sides of the main frame 40, each immediately adjacent the chain of push rods with which it is associated. The drive 70 associated with one of the chains of push rods 4, is mounted more closely to the side of the roadway 1 opposite the mouth of the driveway 2 than the hydraulic deive 71 associated with the other chain 5 of push rods. The space between the wall of the roadway 1 opposite the mouth of the driveway 2 and the chain 5 of push rods associated with the drive mechanism 71 accommodates the conveyor belt 80.

Both the hydraulic drives 70, 71 are aligned axially with the carriages 34, 34' in the roadway 1. Since one of the carriages 34' accommodates two parallel chains of push rods, the hydraulic drive 71 associated with that carriage 34' is pivotable about a vertical axis so that the drive 70 can be adjusted to act along the roadway 1 in two different angular orientations each aligned with a respective one of the chains of push rods on the carriage 34'.

The working surface 49 of the main frame 40 carries guide rails 95, 96, 97 and 98 which guide the chains 4, 5 of push rods over the working surface as the thrust mechanisms are operated.

Figure 6:
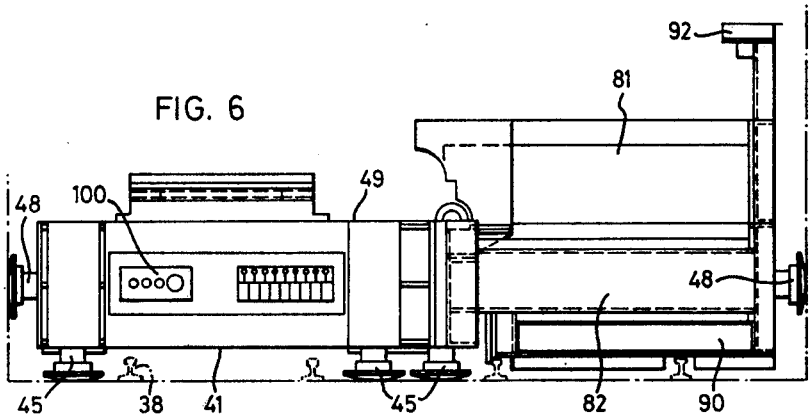
FIG. 6 is a side elevation of the apparatus of FIG. 5.

A control panel for operating the thrust mechanism is situated to one side of the main frame 40, as indicated at 100 in FIG. 6. The control station 100 is composed of an array of hydraulic fluid control valves for operating the hydraulic drive 70 in synchronism with the hydraulic drive 51 and the hydraulic drive 71 in synchronism with the hydraulic drive 50 so that the two chains of push rods 4, 5 can each be withdrawn from the carriages 34 in the roadway 1 and feed smoothly into the driveway 2.

It will be appreciated that as each push rod is advanced from the roadway into the driveway, in the initial part of the 90° turning movement of the push rod on the working surface the end of the push rod nearer the driveway 2 must move more quickly than the other end of the rod, whereas, in the final part of the turning movement, the end of the push rod nearer the driveway 2 must move more slowly than the other end. A similar speed differential will occur during withdrawal of the push rods from the driveway.

In order to provide this speed differential, the two sets of hydraulic drives 51, 70, and 50, 71 are operated by hydraulic control circuits which generate a constant thrust in each of the drives. Each drive then applies a steady force to its respective push rod throughout its travel, irrespective of the speed of movement of the push rod at any point during the travel of the hydraulic drive. This constant thrust can be achieved by incorporating an accumulator for hydraulic fluid in the control circuit for each drive, so that when the push rods are moving slowly, excess hydraulic fluid is directed into the accumulator. Alternatively, the drives may be powered by a large-delivery hydraulic pump and the hydraulic circuit for each drive fitted with a relief valve, which directs excess fluid from the pump to a reservoir when the push rods are moving slowly.

In use, the feeding apparatus is advanced along the rails 38 in the roadway 1 into an appropriate position. The jacking cylinders 45 are then extended so that the wheels 41, 42 are lifted clear of the rails and so that the working surface 49 is horizontal. The staking cylinders 48 are then extended into contact with the walls of the roadway 1 thus locking the main frame 40 in position.

The carriages 34, 34' on which the chains 4, 5 of push rods 8 have previously been loaded are then advanced towards the main frame 40 and the position of the hydraulic drive 71 is adjusted so that it is aligned with one of the chains of push rods on the carriage 34'. The mining machine is then loaded onto the main frame 40. The latches on the hydraulic drives 70, 71 are then raised to engage with the rearmost pins 18, 19 on the first push rods of the chains 4, 5 on the carriages 34, 34'. The hydraulic drives 70, 71 are then reciprocated towards the frame 40 so that the chains 4, 5 are withdrawn from the carriages 34, on to the working surface 49 of the frame 40, where they can be coupled to the rear of the mining machine. The latches of the drives 70, 71 are then depressed, the drives 70, 71 are reciprocated back from the frame 40 and the latches are again raised to engage the rearmost pins 19 on the next push rods in the chains 4, 5.

The latches 56 of the hydraulic drives 50, 51 are then raised and brought into engagement with an abutment on the base of the mining machine. Operating the drive 51 simultaneously with the drive 70 and the drive 50 simultaneously with the drive 71, the machine is then advanced towards the wall of the roadway 1 to commence excavation of the driveway 2. As the excavation proceeds, the conveyor 80, which is coupled to the rear of the machine is drawn into the driveway behind the machine. When the cylinders 55 of the drives 50, 51 have reached the ends of their first strokes, the latches 56 are lowered and the cylinders are reciprocated away from the mouth of the driveway to begin a new stroke. The latches 57 are then raised into the position shown in FIG. 7. In this position, the latches 57 engage with the first sets of pins 18 of the first push rods 8. The drives 51, 70 and 50, 71 are again operated simultaneously so that the machine is advanced further into the driveway 2, by a distance equal to one half the length of a push rod. The drives 51, 70, 50, 71 are then stopped. The latches 57 of drives 50, 51 of the first thrust mechanism are then lowered, the drives 50, 51 are reciprocated away from the driveway 2, and the latches 57 are raised to engage the rearmost pins 19 on the first push rods 8. The drives 51, 70 and 50, 71 are again operated simultaneously so that the machine is advanced still further into the driveway by a distance equal to one half the length of a push rod. The latches of all four drives 50, 51, 70, 71 are then lowered and all four drives are reciprocated away from the mouth of the driveway 2. The latches of the drives 70, 71 are then raised to engage the rearmost pins 19 on the next push rod in the chains in the roadway, and the latches of the drives 50, 51 are raised to engage the front pins 18 of the next push rod on the working surface 49. Further cycles of operations is then executed in the manner described above.

As each push rod 8 approaches the mouth of the driveway 2, the conveyor rollers 16 are swung into the extended positions illustrated in FIG. 3 and are locked in the extended position by the latches 25, and by tie bars 22 which are passed through the opposite brackets 21 of the push rods 6 of the chains. In addition, the roof supports 30 are moved into their raised positions. The roof supports and the tie bars 22 prevent the chains from buckling as the machine is advanced into the driveway.

During the course of the excavation a check can be kept on the horizontal alignment of the machine by means of the sighting device 92, and any deviations corrected by an appropriate adjustment in the steering mechanism of the machine.

When the excavation of the driveway is complete, the machine is withdrawn from the driveway 2 by adopting the reverse of the procedure just described. In order to effect the withdrawal, the recess 64 on the side of the latch members 57 remote from the driveway is brought into engagement with the pins 18, 19 of the push rods 6.

It will be observed from FIG. 1 that because separate synchronised thrust mechanisms are used to advance the parts of the chains 4, 5 in the roadway 1 and in the driveway 2, the push rods can be inclined to each other at relatively large angles on the surface 49 of the frame 4 and can be manufactured in relatively long sections, e.g. up to four or five feet in length.

I claim:

1. Apparatus for feeding one or more chains of connected push rods into a driveway extending laterally from a mine roadway and comprising a first thrust mechanism for applying force to the push rods in a first direction along the driveway, a second thrust mechanism for applying force to the push rods in a second direction laterally of said first direction along the roadway, means for operating the first thrust mechanism together with the second thrust mechanism, said first thrust mechanism including two drives for applying force along the driveway to two separate chains of push rods, a second thrust mechanism including two further drives each for applying force along the roadway to a respective one of the chains and each operable together with a respective one of the drives of the first thrust mechanism, the drives of the first and second thrust mechanisms each including hydraulic cylinder and releasable couplings for connecting the cylinders to the push rods, and the releasable couplings comprise hydraulically operable latches mounted on the hydraulic cylinders.

2. Apparatus for feeding one or more chains of connected push rods into a driveway extending laterally from a mine roadway and comprising a first thrust mechanism for applying force to the push rods in a first direction along the driveway, a second thrust mechanism for applying force to the push rods in a second direction laterally of said first direction along the roadway, means for operating the first thrust mechanism together with the second thrust mechanism, the first thrust mechanism including two drives for applying force along the driveway to two separate chains of push rods, a second thrust mechanism including two further drives each for applying force along the roadway to a respective one of the chains and each operable together with a respective one of the drives of the first thrust mechanism, and at least one of the drives of the second thrust mechanism is adjustable to act along the roadway in a plurality of different angular positions so that the thrust mechanism can be coupled to each of a plurality of adjacent chains of push rods extending along the roadway.

3. Apparatus for feeding one or more chains of connected push rods into a driveway extending laterally from a mine roadway and comprising a first thrust mechanism for applying force to the push rods along the driveway, a second thrust mechanism for applying force to the push rods along the roadway, means for operating the first thrust mechanism together with the second thrust mechanism, said first thrust mechanism including two drives for applying force along the driveway to two separate chains of push rods, a second thrust mechanism including two further drives each for applying force along the roadway to a respective one of the chains and each operable together with a respective one of the drives of the first thrust mechanism, said first and second thrust mechanism drives each comprising hydraulic cylinders and releasable couplings for connecting the cylinders to the push rods, and the releasable couplings including hydraulically operable latches mounted on the hydraulic cylinders.

4. Apparatus for feeding one or more chains of connected push rods into a driveway extending laterally from a mine roadway and comprising a first thrust mechanism for applying force to the push rods along the driveway, a second thrust mechanism for applying force to the push rods along the roadway, means for operating the first thrust mechanism together with the second thrust mechanism, said first thrust mechanism including two drives for applying force along the driveway to two separate chains of push rods, a second thrust mechanism including two further drives each for applying force along the roadway to a respective one of the chains and each operable together with a respective one of the drives of the first thrust mechanism, and at least one of the drives of the second thrust mechanism being adjustable to act along the roadway in a plurality of different angular positions so that the thrust mechanism can be coupled to each of a plurality of adjacent chains of push rods extending along the roadway.

* * * * *

UNITED STATES PATENT OFFICE

CERTIFICATE OF CORRECTION

PATENT NO. : 4,173,280

DATED : Nov. 6, 1979

INVENTOR(S) : Gordon Bertram Dawson

It is certified that error appears in the above-identified patent and that said Letters Patent are hereby corrected as shown below:

[30] Foreign Application Priority Data

Great Britain 41880/76 of October 8, 1976.

Signed and Sealed this

*Fifteenth* Day of *January 1980*

[SEAL]

*Attest:*

SIDNEY A. DIAMOND

*Attesting Officer*

*Commissioner of Patents and Trademarks*